US005955999A

United States Patent [19]

Mutz et al.

[11] Patent Number: 5,955,999

[45] Date of Patent: Sep. 21, 1999

[54] ANTENNA ASSEMBLY FOR A RADIOTELEPHONE

[75] Inventors: Leslie Dean Mutz, Vernon Hills, Ill.; Thomas Anthony Petrella, Burlington, Wis.; Li Chen, Grayslake, Ill.

[73] Assignee: Motorola, Inc., Schaumburg, Ill.

[21] Appl. No.: 08/950,635

[22] Filed: Oct. 15, 1997

[51] Int. Cl.[6] ..... H01Q 1/36

[52] U.S. Cl. ..... 343/895; 343/702; 343/872; 343/906

[58] Field of Search ..... 343/895, 872, 343/906, 702; H01Q 1/24, 1/36

[56] References Cited

U.S. PATENT DOCUMENTS

| | | | |
|---|---|---|---|
| 4,725,395 | 2/1988 | Gasparaitis | 343/873 |
| 4,882,591 | 11/1989 | Galvin et al. | 343/715 |
| 5,146,235 | 9/1992 | Frese | 343/895 |
| 5,502,452 | 3/1996 | Gomez | 343/715 |
| 5,616,043 | 4/1997 | Liou | 343/906 |
| 5,742,259 | 4/1998 | Annamaa | 343/895 |

*Primary Examiner*—Don Wong
*Assistant Examiner*—Tan Ho
*Attorney, Agent, or Firm*—John J. Oskorep; Rolland R. Hackbart

[57] ABSTRACT

An antenna (116) includes an antenna cap (1300), a helical coil (1302), and a bushing (1304). The antenna cap (1300) is sized to fit the helical coil (1302) and forms a bushing threading. The bushing (1304) forms a cylindrical portion (1320) and a cylindrical portion (1322). The cylindrical portion (1320) is sized to receive the helical coil (1302). The cylindrical portion (1322) defines a cap threading and is configured to threadedly receive the antenna cap (1300).

8 Claims, 3 Drawing Sheets

ANTENNA ASSEMBLY FOR A RADIOTELEPHONE

FIELD OF THE INVENTION

The present invention relates generally to the field of antenna assemblies.

BACKGROUND OF THE INVENTION

There is a need for an antenna assembly in a radiotelephone that provides for an easy assembly and a secure attachment to the radiotelephone.

FIG: 3 is an exploded view of an antenna of the radiotelephone.

Figure 4:
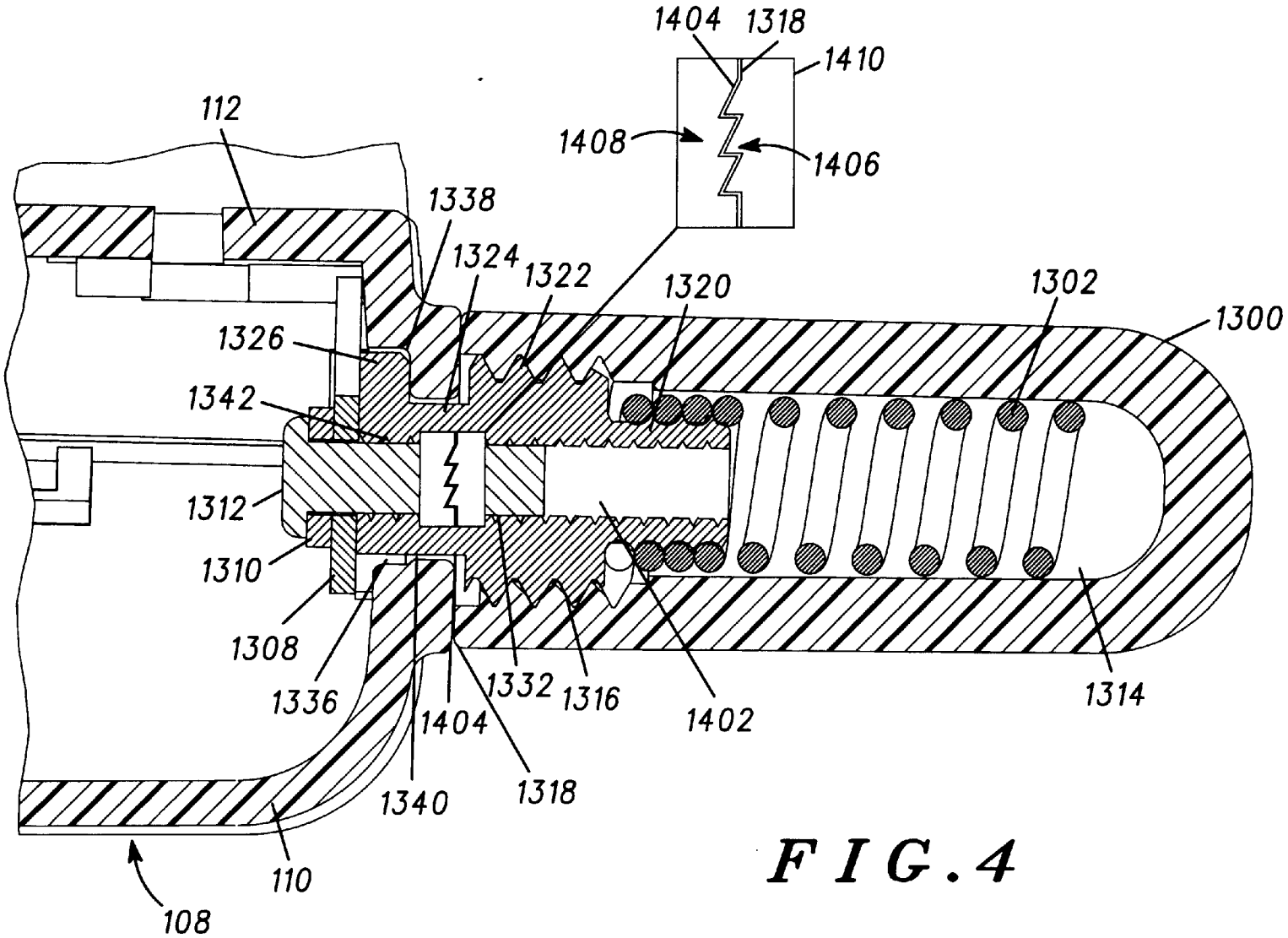

FIG. 4 is a cross section view of the antenna and a bottom housing of the radiotelephone.

DETAILED DESCRIPTION OF THE PREFERRED EMBODIMENTS

An antenna includes an antenna cap, a helical coil, and a bushing. The antenna cap is sized to fit the helical coil and forms a bushing threading. The bushing forms a first cylindrical portion and a second cylindrical portion. The first cylindrical portion is sized to receive the helical coil. The second cylindrical portion defines a cap threading and is configured to threadedly receive the antenna cap. The antenna cap preferably includes a mating perimeter having retaining notches.

Figure 1:
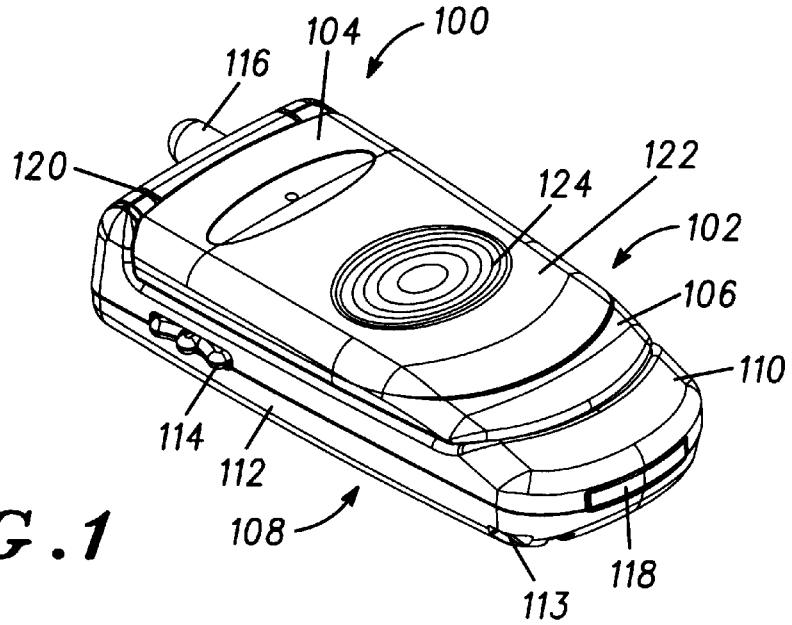
FIG. 1 is a perspective view of a radiotelephone in a closed position, showing an antenna.

Turning to FIG. 1, a perspective view shows a radiotelephone 100 in a closed position. Radiotelephone 100 comprises a top housing 102 housing 108 having a front portion 110 and a back portion 112. Back portion 104 of bottom housing 108 includes a first guide slot 113. Bottom housing 108 also includes a switch assembly 114 preferably on the side of radiotelephone 100 and an antenna 116 generally extending from a rear of radiotelephone 100. A connector 118 is also provided to generally enable input/output of data or provide a port for a cigarette lighter adapter. An indicator 120, such as a light guide for a light emitting diode (LED), is incorporated in a knuckle of a hinge of radiotelephone 100. Finally, back portion 104 of top housing 102 comprises a top surface 122 having a finger locator 124.

Figure 2:
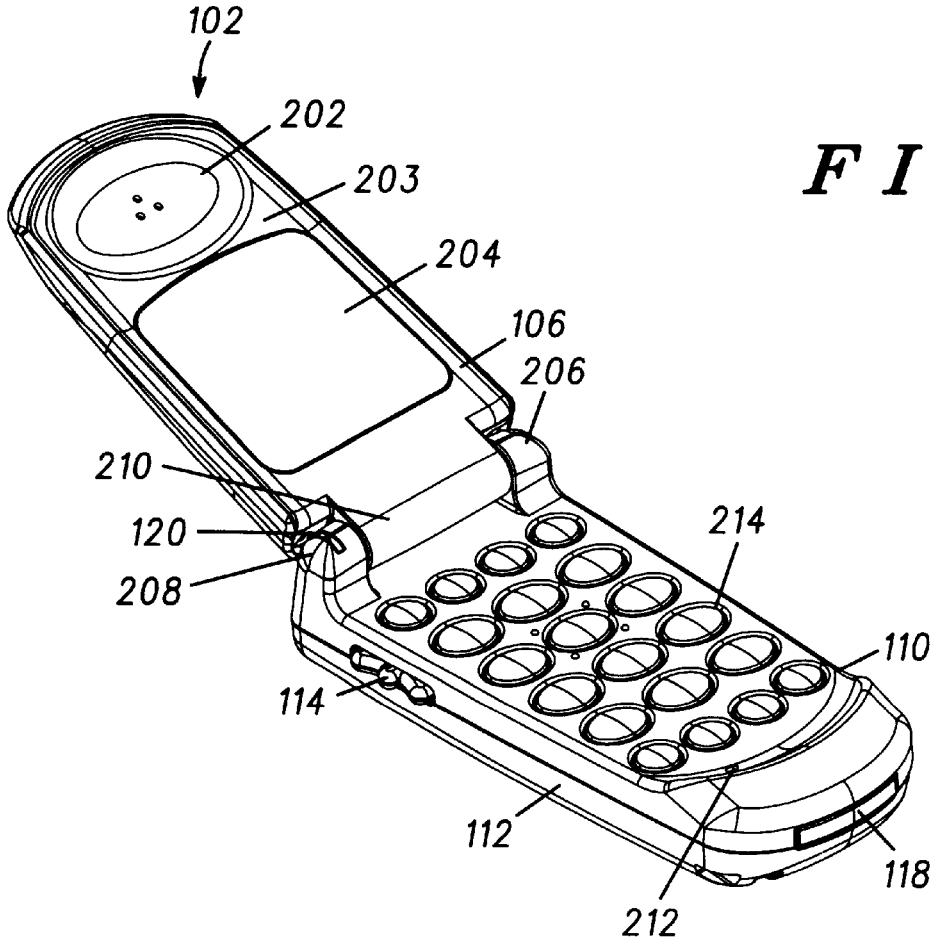
FIG. 2 is a perspective view of the radiotelephone in an open position.

Turning now to FIG. 2, radiotelephone 100 in the open position shows top housing 102 rotatably connected to bottom housing 108. Here, an angle θ of about 160 degrees is defined between top and bottom housings 102 and 108. Front portion 106 of top housing 102 comprises an earpiece 202 defined in a bottom surface 203 and a lens 204 positioned in an aperture of top housing 102. Front portion 110 of bottom housing 108 comprises a first knuckle 206 and a third knuckle 208 which are coupled to a second knuckle 210 of top housing 102. Bottom housing 108 also includes a microphone 212 disposed therein.

Figure 3:
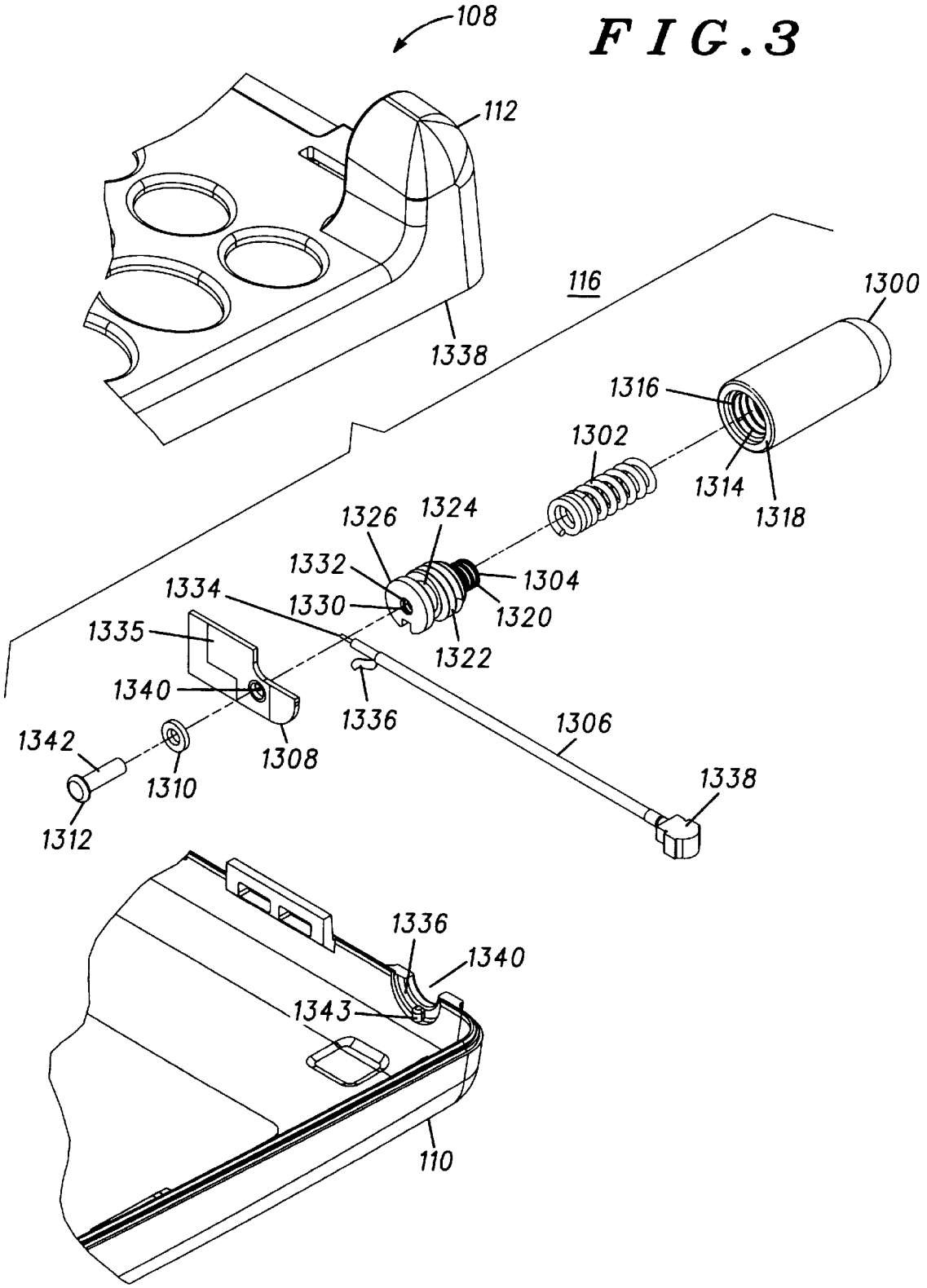

FIG. 3 is an exploded view of antenna 116. Antenna 116, which may be referred to as an antenna assembly and a stubby antenna, includes an antenna cap 1300, a helical coil 1302, a bushing 1304, a coaxial cable 1306, a substrate 1308 forming a ground plane, a washer 1310, and a screw 1312.

Antenna cap 1300 forms a pocket 1314 and includes a bushing threading 1316 in pocket 1314. A mating perimeter 1318 is formed around an opening of pocket 1314. Pocket 1314 is sized to fit helical coil 1302. Antenna cap 1300 is made from a durable and pliable material, preferably plastic.

Bushing 1304 forms a body including a cylindrical portion 1320 having a coil threading, a cylindrical portion 1322 having a cap threading, a cylindrical portion 1324, and a cylindrical portion 1326 having a notch 1328. Cylindrical portion 1320 has a diameter that is less than a diameter of cylindrical portion 1322, and cylindrical portion 1324 has a diameter that is less than a diameter of cylindrical portion 1326. Bushing 1304 also includes a pocket 1330 through a longitudinal axis thereof, which includes a screw threading 1332. In this embodiment, bushing 1304 is electrically conductive and forms cylindrical portions 1320, 1322, 1324, and 1326.

Coaxial cable 1306, which here provides an impedance of 50 ohms, includes a coax lead 1334, a coax sheathing 1336, and a connector 1338 coupled to coax lead 1334 and coax sheathing 1336. Substrate 1308 has a ground plane 1335 on a bottom side thereof and a hole 1340. Screw 1312 includes a screw threading 1342 and washer 1310 is preferably a non-conductive, nylon washer. In this embodiment, helical coil 1302 is a quarter wavelength monopole, where antenna 116 forms a half-wave dipole with ground plane 1334 and coaxial cable 1306.

For assembly, bushing 1304 is abutted to substrate 1308 such that a hole of pocket 1330 is aligned with hole 1340. Screw 1312 is inserted through washer 1310 and hole 1340 of substrate 1308. Next, screw 1312 is threadedly attached within bushing 1304 using screw threadings 1332 and 1342 such that bushing 1304 becomes snug fit against substrate 1308. Coax lead 1334 is then soldered to a bottom of cylindrical portion 1326, and coax sheathing 1336 is soldered to ground plane 1335. Helical coil 1302 is threadedly attached to the coil threading of cylindrical portion 1320, thereby coupling helical coil 1302 to coax lead 1334.

Back portion 110 and front portion 112 include counterbores 1336 and 1338, respectively, which form a hole 1340 for bottom housing 108 when back and front portions 110 and 112 are mated. First, bushing 1304 is nested in counterbore 1338. Coaxial cable 1306 is routed in front portion 112 and later coupled to a transceiver (not shown) with connector 1338. Back portion 110 is mated with front portion 112, where notch 1328 of bushing 1304 aligns with a key 1343 of back portion 110. Back and front portions 110 and 112 capture bushing 1304 around hole 1312.

After back and front portions 110 and 112 are secured, bushing threading 1316 of antenna cap 1300 is threadedly attached around the cap threading of cylindrical portion 1322. Antenna cap 1300 is turned until mating perimeter 1318 is abutted with a mating perimeter 1404 (FIG. 4) of bottom housing 108. Key 1343 retains bushing 1304 in place.

FIG. 4 is a cross sectional view of antenna 116. Bushing 1304 further includes a hole 1402. As shown in a non-cross sectional view 1410, mating perimeter 1318 preferably includes retaining notches 1406 formed therearound. Retaining notches 1406 may be referred to as locking notches. Mating perimeter 1404 of back portion 110 includes retaining notches 1408 that are sized and constructed to fit and retain retaining notches 1406 when abutment occurs. In this embodiment, retaining notches 1406 and 1408 are formed similar to that of well-known ratchet teeth. When engaged, retaining notches 1408 and 1406 prevent removal of antenna cap 1300 after seating.

While particular embodiments of the present invention have been shown and described, modifications may be made. It is therefore intended in the appended claims to cover all such changes and modifications which fall within the true spirit and scope of the invention.

What is claimed is:

1. An antenna assembly, comprising:

a helical coil;

an antenna cap sized to fit said helical coil and forming a bushing threading, said antenna cap having a first mating perimeter with at least one retaining notch configured to prevent removal of the antenna cap; and a bushing forming a first cylindrical portion and a second cylindrical portion, said first cylindrical portion sized to receive said helical coil, said second cylindrical portion defining a cap threading and configured to threadedly receive said antenna cap.

2. The antenna assembly according to claim 1, wherein said first cylindrical portion defines a coil threading to threadedly receive said helical coil.

3. The antenna assembly according to claim 1, wherein said bushing is electrically conductive, said antenna assembly further comprising:

a substrate including a ground plane; and a coaxial cable having a coax lead electrically coupled to said second cylindrical portion and a coax sheathing electrically coupled to said ground plane.

4. The antenna assembly according to claim 1, wherein said at least one retaining notch is formed of at least one ratchet teeth.

5. The antenna assembly according to claim 1, further comprising a housing for attachment of the antenna assembly, wherein said housing has a second mating perimeter for mating with the antenna cap.

6. The antenna assembly according to claim 5, wherein said second mating perimeter is configured to have at least one locking notch.

7. The antenna assembly according to claim 6, wherein said at least one locking notch is configured to retain said at least one retaining notch when the antenna cap is seated on the housing.

8. The antenna assembly according to claim 7, where said at least one locking notch and said at least one retaining notch are formed by ratchet teeth.

* * * * *